United States Patent [19]

Terzian

[11] 4,261,134

[45] Apr. 14, 1981

[54] ANIMATED DOLL HAVING AXIALLY ROTATED GRASPING LIMB ACTION

[75] Inventor: Rouben T. Terzian, Chicago, Ill.

[73] Assignee: Marvin Glass & Associates, Chicago, Ill.

[21] Appl. No.: 10,935

[22] Filed: Feb. 9, 1979

[51] Int. Cl.[3] ..... A63H 29/16; A63H 13/02; A63H 11/00

[52] U.S. Cl. ..... 46/44; 46/141; 46/119

[58] Field of Search ..... 46/44, 141, 119, 118, 46/135 R

[56] References Cited

U.S. PATENT DOCUMENTS

| | | | |
|---|---|---|---|
| 2,804,720 | 9/1957 | Olson | 46/118 |
| 3,125,827 | 3/1964 | Ostrander | 46/141 |
| 3,514,899 | 6/1970 | Bonanno et al. | 46/118 |
| 3,534,495 | 10/1970 | Goldman | 46/44 UX |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

An animated doll includes a hollow body with a head having a face with a mouth opening and movable limbs mounted on the body. An internal pneumatic motor in the form of a bellows is mounted in the hollow body in fluid communication with the mouth opening and the motor is drivingly interconnected with the limbs of the doll including arms and legs pivotally mounted on the body. A fluid pump in the form of a nursing bottle is insertable into the doll's mouth and when systematically compressed and released, the inserted bottle actuates the pneumatic motor to pivot the arms and legs of the doll to a position wherein the limbs appear to hold the nursing bottle in a nursing position.

1 Claim, 6 Drawing Figures

ANIMATED DOLL HAVING AXIALLY ROTATED GRASPING LIMB ACTION

BACKGROUND OF THE INVENTION

1. Field of the Invention

The present invention relates to animated dolls and more particularly relates to an animated doll wherein a fluid pump in the form of a nursing bottle is inserted into the mouth of the doll and is operated as a pump to cause the doll's arms and legs to pivot toward a nursing position wherein the hands and feet appear to hold the nursing bottle in the nursing position inserted into the doll's mouth.

2. Description of the Prior Art

Over the years a wide variety of animated dolls have been developed. Many of these dolls provide realistic action or motions which portray the movement and activities of young children or babies. U.S. Pat. Nos. 3,090,156; 3,125,828; 3,229,421; 3,534,495; 3,594,942; 3,600,845; 3,740,893; 3,882,631; 3,996,695; and 4,067,132 all disclose animated dolls designed to simulate childlike activities of a wide and varied nature.

As far as is known, no prior art animated dolls have been developed wherein a fluid pump in the form of a simulated nursing bottle is insertable into the doll's mouth and is operable by compressing and releasing to activate a fluid motor for causing the doll's arms and legs to move into a position simulating the holding of the nursing bottle as it would be held by the hands and feet of a young child while nursing.

OBJECTS OF THE INVENTION

Accordingly, it is an object of the invention to provide a new and improved animated doll and more particularly a new and improved animated doll which is designed to simulate the nursing activity of a young child or baby with a nursing bottle.

More particularly, it is another object of the present invention to provide a new and improved animated doll wherein a nursing bottle having a nipple insertable into the doll's mouth is effective as an air pump for activating an internal pneumatic motor within the doll's body to cause the doll's arms and legs to move to a nursing position appearing to hold the nursing bottle in a nursing position with the nipple inserted in the doll's mouth.

More specifically, it is an object of the present invention to provide a new and improved animated doll of the character described wherein the arms of the doll are moved to a position appearing to hold or clasp a nursing bottle which is inserted into the doll's mouth simulating nursing activity.

Yet another object of the present invention is to provide a new and improved animated doll of the character described wherein the legs of the doll are movable to a position appearing to support the nursing bottle inserted into the doll's mouth.

Yet another object of the present invention is to provide a new and improved animated doll of the character described wherein both the arms and the legs are moved simultaneously to a nursing position appearing to grasp and hold the nursing bottle in the nursing position with the nipple inserted in the doll's mouth.

Another object of the present invention is to provide a new and improved nursing doll of the character described wherein the arms of the doll are movable and are activated by pumping action on a nursing bottle to appear to clasp opposite sides of a nursing bottle while inserted into the doll's mouth.

Yet another object of the present invention is to provide a new and improved nursing doll of the character described wherein the doll's legs are movable and are activated by a pumping type action on the nursing bottle which results in the legs being pivoted into a position appearing to support the bottle in the nursing position.

Yet another object of the present invention is to provide a new and improved nursing doll of the character described wherein a doll's legs are pivotally mounted on the doll's body and are movable about a pair of separate pivot axes from a rest position toward a nursing position appearing to support a nursing bottle in position with the nipple inserted into the doll's mouth.

Still another object of the invention is to provide a new and improved nursing doll of the character described wherein one or more of the doll's limbs are manually adjustable through a range of relative rotational positions about an axis extended longitudinally of the limb to a selected rotative position.

SUMMARY OF THE INVENTION

The foregoing and other objects and advantages of the present invention are accomplished in an illustrated embodiment comprising a new and improved animated nursing doll which includes a hollow body with a head and face having a mouth opening and arms and legs pivotally attached to the doll's body for movement between a first or resting position and a second or active nursing position. The doll is provided with an internal pneumatic motor which is drivingly interconnected with the arms and legs so that when a fluid pump in the form of a nursing bottle has its nipple inserted into the mouth of the doll and is then systematically squeezed and released in a pumping type action, the pneumatic motor is activated to drive the limbs from the rest position toward the nursing position wherein the hands and feet of the doll appear to clasp and support the nursing bottle in the nursing position. After removal of the nursing bottle from the doll's mouth, the arms and legs of the doll then return back to the first or rest position.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
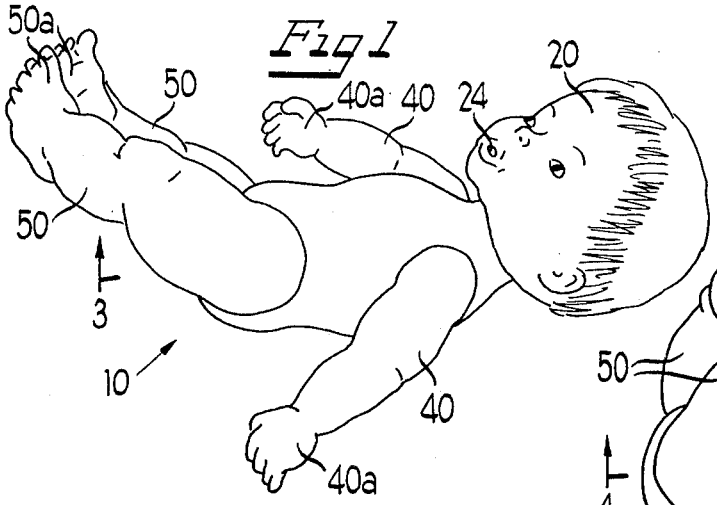
FIG. 1 is a perspective view of a new and improved animated nursing doll shown in a position with the arms and legs extended outwardly of the doll's body in a first or rest position.

Referring now more particularly to the drawings, therein is illustrated a new and improved animated nursing doll 10 constructed in accordance with the features of the present invention. In FIG. 1 the doll is shown in a first or resting position and in FIG. 2, the doll is illustrated in a second or active nursing position wherein the arms and legs of the doll are positioned to appear like they are holding and supporting a nursing bottle 12 with its nipple inserted into the doll's mouth.

The doll includes a hollow body 14 preferably formed of thin, flexible molded plastic material in the shape of the body of a young child or baby. At the upper end, the body is formed with a generally cylindrical, neck portion 16 which projects upwardly in coaxial alignment with a supportive annular ring 18 which is mounted internally at the lower end or neck of a hollow head 20 also preferably formed of thin flexible plastic material in the shape of the head of a young child or baby as illustrated.

Figure 5:
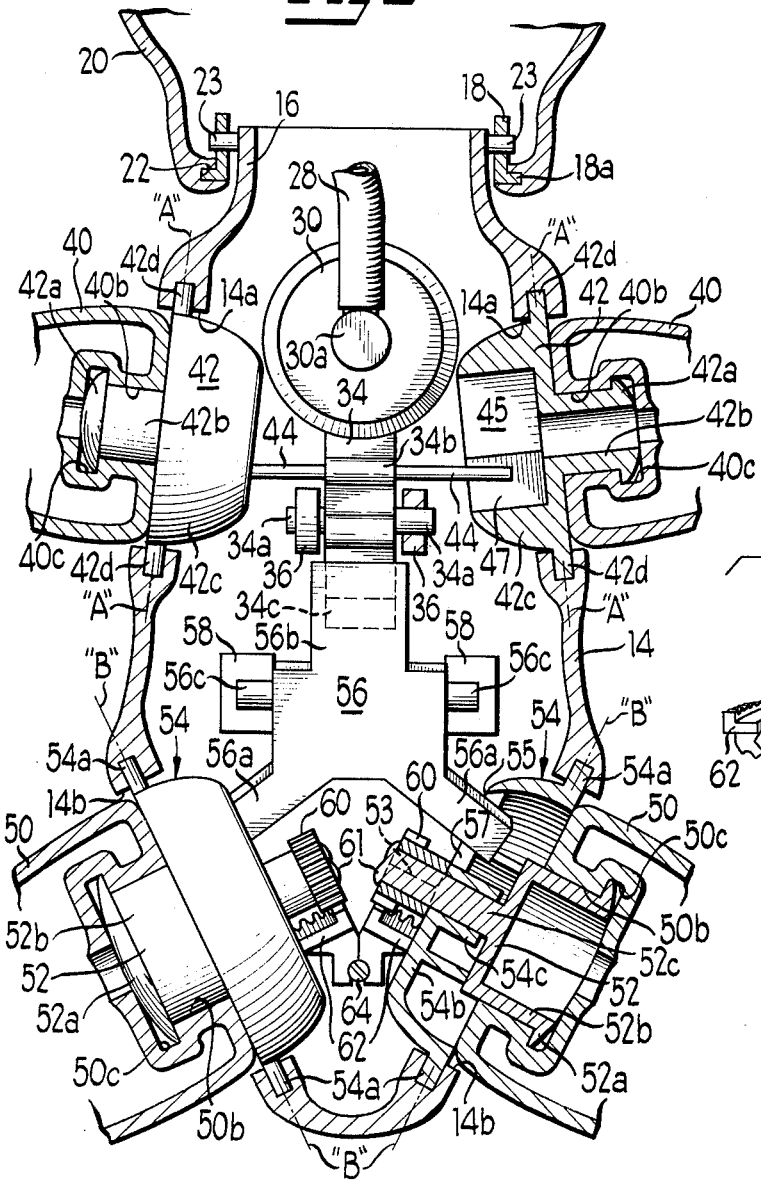
FIG. 5 is a longitudinal cross-sectional view of the doll taken substantially along lines 5—5 in a plane normal or perpendicular to the plane of FIG. 3.
Figure 3:
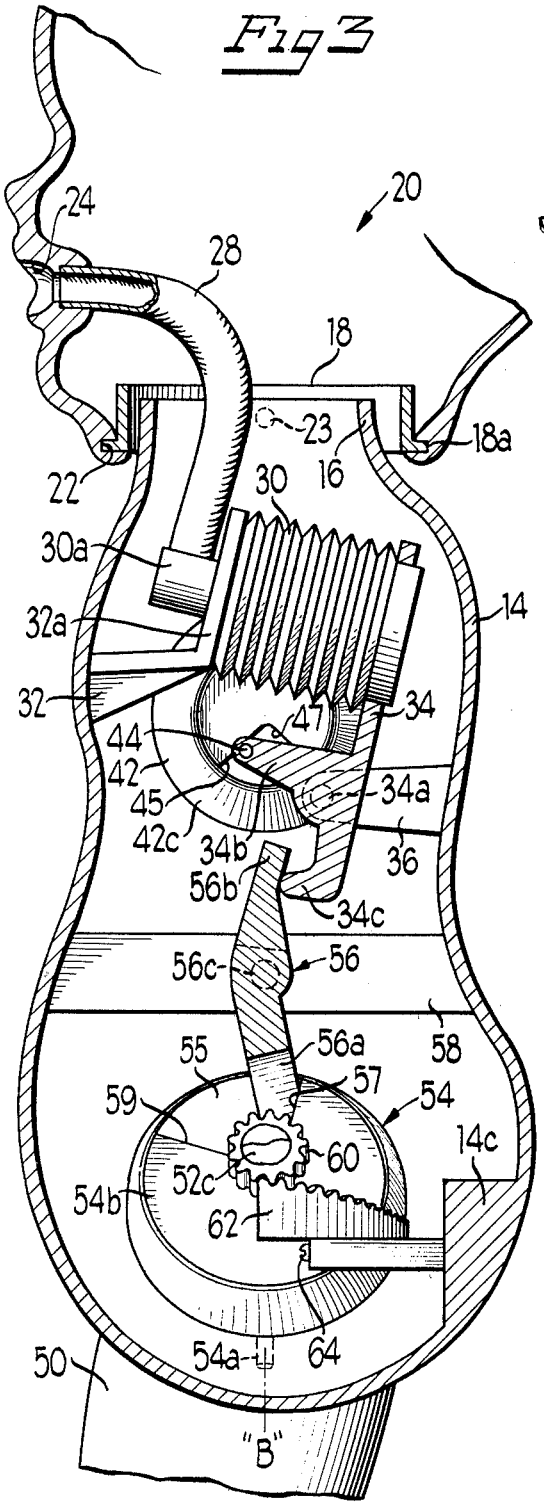
FIG. 3 is a longitudinal cross-sectional view through the doll's body taken substantially along lines 3—3 of FIG. 1.
Figure 4:
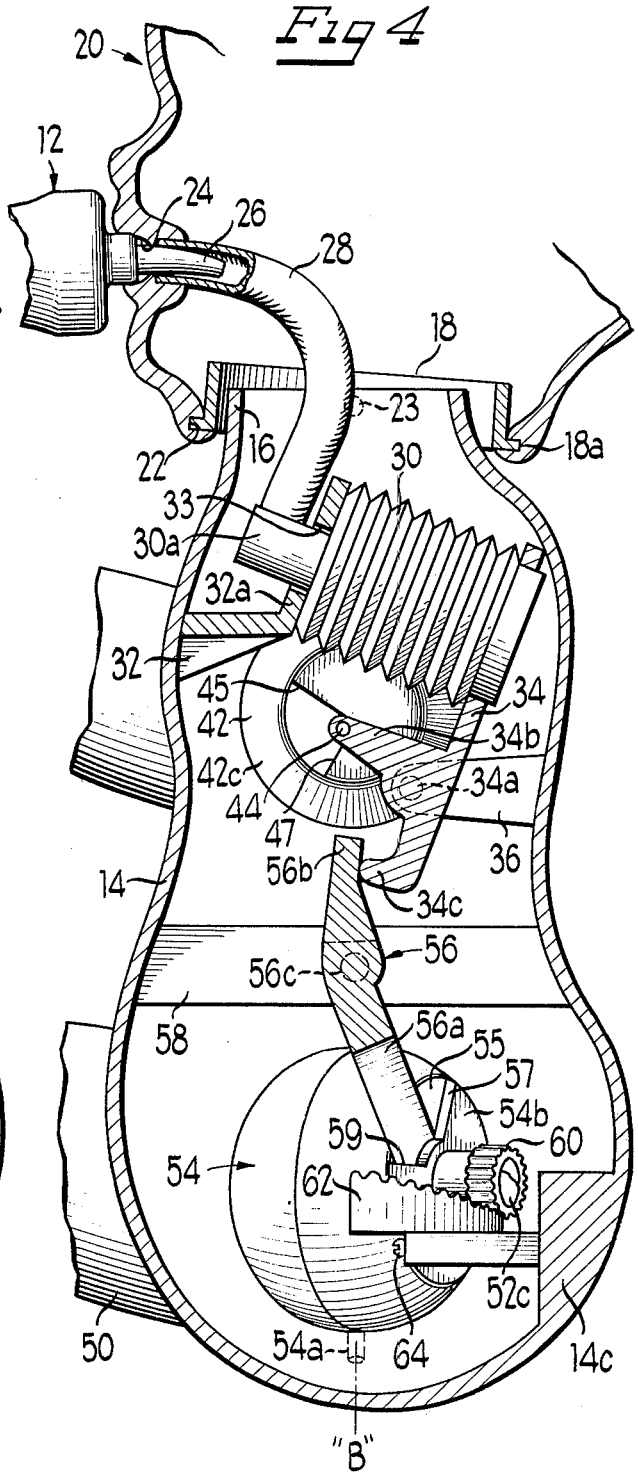
FIG. 4 is a longitudinal cross-sectional view similar to FIG. 3 taken substantially along lines 4—4 of FIG. 2.

As illustrated in FIGS. 3, 4 and 5, the internal neck ring 18 includes a lower radial flange 18*a* which is seated in an annular groove 22 formed in the neck at the lower end of the doll's head. The doll's head is rotatively mounted on the flange 18*a* so that the face of the doll may be adjusted to a selected rotative position wherein frictional contact between the flange and the surfaces of the groove provide a holding force for maintaining the doll's head in the position that is selected. The internal neck ring 18 is mounted on a pair of diametrically opposed, support pins 23 extending outwardly from opposite sides of the neck portion 16 of the body so that the head 20 may rock freely back and forth.

In accordance with the invention, the front of the hollow doll's head 20 is shaped with the customary facial features and includes a mouth opening 24 outlined by lips on the face and adapted to receive a nipple portion 26 (FIG. 4) at one end of the nursing bottle 12 as shown. The nursing bottle is formed of thin, flexible, plastic material and is largely hollow to serve as a pneumatic pump when systematically squeezed and released in a pumping type action to force fluid under pressure into the doll's mouth via the nipple. The mouth is connected to an inlet end of an internal tube 28 which extends downwardly through the open neck portion 16 into the chest portion of the hollow body 14. An opposite end of the tube is connected in fluid communication with one end 30*a* of a pneumatic motor which takes the form of an expandable bellows chamber 30 mounted in the chest portion of the hollow body 14 as illustrated in FIGS. 3, 4 and 5.

The inlet end 30*a* of the expandable bellows is mounted in fixed relation to the body 14 on an internal bracket 32 having a circular base portion 32*a* formed with an aperture 33 therein for receiving the inlet fitting connected to the flexible internal tube 28.

The opposite end of the bellows is closed with a circular end wall and is seated within a circular opening provided in an upper end portion of an arm actuating lever 34 mounted for pivotal movement relative to the body on a pair of integral, axle pins 34*a* which project into apertured brackets 36 formed internally of the body 14 and projecting fowardly from a rear wall therefrom.

As the bellows 30 expands and contracts in length, the actuating lever 34 is pivoted or rocked in opposite directions between a first or rest position (FIG. 3) and a second or activated position (FIG. 4) and four or five cycles of squeezing and release type pumping action on the nursing bottle 12 after insertion into the doll's mouth causes the bellows 30 to fully expand and pivot the lever 34 in a clockwise direction from the position of FIG. 3 to the position of FIG. 4.

When pumping action is subsequently discontinued and the bottle is removed, the compressed air in the bellows 30 gradually leaks out through the tube 28 and open mouth 24 permitting the lever 34 to pivot in a counterclockwise direction from the position of FIG. 4 to the position of FIG. 3. The lever 34 includes an intermediate leg portion 34*b* extending outwardly of the support pins 34*a* generally at right angles to the upper portion connected to the bellows 30 and also introduces a lower end portion 34*c* which extends generally longitudinally of the body towards the bottom as illustrated.

In accordance with the invention, the doll 10 includes a pair of arms 40 preferably formed of hollow, thin, flexible, molded plastic material and each arm includes a hand portion 40*a* at the outer end designed to resemble a young child or baby's hand. At the inner end, each arm 40 is formed with an internal, annular socket sleeve 40*b* having an enlarged recess 40*c* adapted to receive a headed outer end portion 42*a* of a socket support member 42. Each arm is supported for adjustable relative rotation about a longitudinal axis of the limb on an outwardly projecting tubular axle 42*b* of a respective socket support and the arms may be manually adjusted to a desired relative position on the supporting axle. Once a desired position is selected, the frictional engagement between the contacting surfaces of the arm socket sleeve 40*b* and groove 40*c* respectively, against the surfaces of the head 42*a* and tubular axle 42*b* of the support member 42 retain the arm in the position as selected.

Each arm support 42 is mounted for pivotal movement about an axis A—A (FIG. 5) extending generally longitudinally of the body 14 on opposite sides thereof. The body is formed with a pair of arm socket openings 14*a* of circular shape for receiving cup-shaped inwardly extending cam portions 42*c* of the socket support members. A pair of diametrically opposed, upper and lower, integrally formed, mounting pins 42*d* are provided on the socket supports and these pins are journaled in coaxially aligned upper and lower cylindrical bearing recesses provided in the upper and lower wall portions of each arm socket opening 14*a*.

Figure 2:
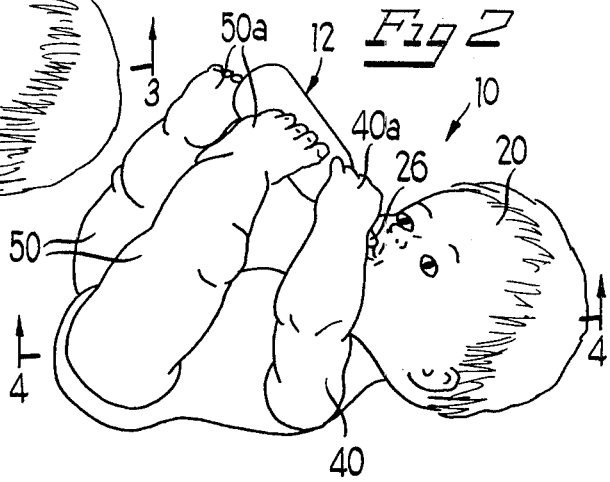
FIG. 2 is a perspective view of the animated doll of FIG. 1 with the doll's arms and legs in a second or nursing position appearing to support a nursing bottle (fluid pump) with the nipple inserted into the doll's mouth.

The arm supports 42 thus provide pivotal movement of the arms 40 about the axes A—A from the laterally outwardly extending first or rest position as shown in FIG. 1 toward a second position extending upwardly as shown in the nursing position of FIG. 2 wherein the hands 40*a* appear to be holding or clasping opposite sides of the nursing bottle 12 with the nipple 26 inserted into the doll's mouth 24.

In order to drivingly interconnect the expandable bellows 30 and the arm actuating lever 34 with both arms 40 through the respective arm supporting sockets 42, the intermediate portion 34*b* of the lever supports laterally extending actuator rod 44 which projects laterally outwardly in opposite directions from the lever as illustrated best in FIG. 5. The opposite outer end portions of the pin 44 are adapted to engage a first radial cam surface 45 formed on a cup-shaped cam portion 42*c* of each socket support member 42 and this engagement causes the support member to pivot about the axis A—A when the lever 34 is pivoted so that the arms 40 will move from the laterally outwardly extended, rest position of FIG. 1 toward the upright, nursing position of FIG. 2. When the bellows type fluid motor 30 expands from the condition shown in FIG. 3 to the enlarged condition of FIG. 4, the actuator pin 44 moves toward a central portion of each cam portion 42*c* formed at the junction of the first radial cam surface 45 and a second radial stop surface 47 at generally right angles thereto. This arrangement provides a lost motion connection between the pin 44 and each arm support 42.

When pressurized fluid is pumped into the bellows 30 by pumping action on the nursing bottle 12, the arms 40 of the doll gradually pivot from the rest position of FIG. 1 to the nursing position of FIG. 2 wherein the hands 40*a* appear to grasp and hold the nursing bottle 12 on opposite sides thereof. Subsequently, when pressure in the bellows 30 beings to leak off and return to an atmospheric level, the arms 40 gradually return downwardly towards the rest position of FIG. 1. As this occurs, the radial cam surfaces 45 of the respective arm support socket members 42 engage opposite end portions of the actuator pin 44, and the lever 34 pivots in a counterclockwise direction as the bellows 30 contracts in length.

Figure 6:
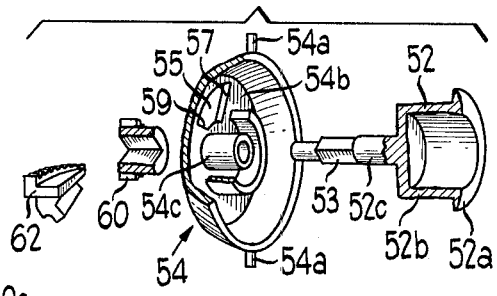
FIG. 6 is an exploded perspective view of a portion of a mounting support and drive means for the doll's leg.

In accordance with the present invention, the nursing doll 10 also includes a pair of legs 50 having outer end portions 50*a* shaped and formed to resemble the feet of a small child or baby. The legs 50 are hollow and are preferably formed of thin, molded, flexible plastic material. Each leg is provided with tubular inner socket sections 50*b*/50*c* at the inner end with an enlarged annular groove adapted to receive the headed end portion 52*a* of a leg support spindle 52 having a cup-like body 52*b* and an inwardly extending, axial stem or shaft 52*c* as shown in FIGS. 5 and 6. Each leg is rotatably adjustable on its respective supporting spindle 52 through a range rotative positions and once a position is selected, the frictional engagement between the surfaces of the socket sleeve 50*b* of a leg and the supporting body 52*b* of the spindle hold the leg in the position as selected.

Each spindle 52 is mounted for axial rotation on a cup-shaped, leg support member 54 (best shown in FIG. 6) having a pair of diametrically opposed, upper and lower, integrally formed mounting pins 54*a* projecting outwardly from the rims of the support member. The pins are seated in cylindrical recesses provided in the upper and lower edges of a pair of enlarged, circular leg socket, openings 14*b* formed on opposite sides of the body 14 adjacent the lower end as shown. The mounting pins 54*a* on each leg support member 54 are aligned on a common pivot axis B—B extending generally longitudinally of the body and these pivot axes B—B are on opposite sides of the body 14 and are convergent toward the lower end.

Each cup-shaped leg support 54 includes a circular base 54*b* having an arcuate slot 55 formed therein with a pair of angularly intersecting radial cam surfaces 57 and 59 which are adapted to be engaged by a downwardly and outwardly extending leg 56*a* on the lower end portion of a Y-shaped, leg activating lever 56. The leg activating lever includes a single upper end portion 56*b* adapted for engagement with the lower end portion 34*c* of the upper arm activating lever 34 as shown in FIGS. 3, 4 and 5.

The lever 56 is supported for pivotal movement in the body 14 intermediate its ends by a pair of integrally formed, laterally outwardly extending pivot pins 56*c* which are journaled in a pair of bearing recesses formed in a pair of spaced apart support brackets 58 extending between the front and back of the body. These brackets are disposed on opposite sides of the central portion of the lever 56 as shown in FIG. 5. As illustrated in FIGS. 3 and 4, when the pneumatic bellows 30 is expanded by pumping pressurized air from the nursing bottle 12, the leg actuating lever 56 is pivoted from the position of FIG. 3 towards the position of FIG. 4 in a counterclockwise direction about the supporting pins 56*c*. As this pivotal action occurs, the lower end portions 56*a* engage the cam surfaces 57 on the respective leg supports 54 on opposite sides of the body causing the doll's legs 50 to pivot inwardly towards the center of the body about their respective pivot axes B—B, and this action is similar to that of the arms 40 as previously described.

Each leg support element 54 is also provided with a central, cylindrical bearing sleeve 54*c* which supports the shaft of a leg support 52 for axial rotation. At the inner end, each shaft 52*c* is formed with flatted key surfaces 53 (FIG. 6) for keyed interconnection with a toothed pinion gear 60 having an axial bore with a cross-section having a flatted surface matching that of the flats 53 on the supporting spindles 52*c*. During assembly, after a shaft spindle 52*c* is inserted into a central bearing sleeve 54*c*, a gear pinion 60 is mounted on the flats of the shaft and the outer end portion is then pushed over to hold the gear in place as shown by the reference numeral 61 in FIG. 5.

The gear pinions 60 are mounted to drive the inner end portions of the shafts 52*c* and rotate the cup portion of the leg supports 52*b*. This causes the legs 50 to rotate about their own longitudinal axes when the gear rotates. The teeth of each pinion gear 60 are intermeshed with an elongated toothed rack 62, and these racks are fixedly secured to the body 14 on an internal, boss-like portion 14*c* by a single mounting screw 64. The teeth of the respective racks 62 are arranged to lie on a path traversed by the peripheral teeth of the adjacent pinion gear 60 as the respective leg support element 64 is rotated about its axis B—B by movement of the leg activating lever 56.

The movement of the legs 50 is thus compound in nature and includes rotational movement about a longitudinal axis of the limb as well as a rocking or pivotal movement about the respective support axis B—B extending generally longitudinal of the doll's body. This type of compound movement closely approximates an actual real life movement of a baby or young child's leg and closely simulates a child's leg action to hold a nursing bottle in the nursing position as shown in FIG. 2.

Referring to FIGS. 1 and 2, as the doll's legs 50 are pivoted from the rest position, upwardly toward the bottle holding, or nursing position, each leg is also rotated about its longitudinal axis so that the toes of the feet 50*a* turn inwardly during elevation of the leg. When the legs are fully raised the feet 50*a* appear to be holding the outer end portion of the nursing bottle 12 on opposite sides thereof. Individually, one leg 50 may be rotated on its supporting spindle element 52 so that one of the legs will be positioned farther toward the nipple 26 than the other leg when the legs are raised upwardly into the nursing position.

When the pumping action on the nursing bottle 12 is terminated, the legs 50 gradually return from the nursing position of FIG. 2 towards the rest position of FIG. 1 and as this occurs, the leg supporting socket elements 54 pivot about the respective axes B—B and simultaneously the legs themselves rotate about their respective longitudinal limb axes so that the toes of the feet 50*a* turn somewhat outwardly when the legs reach the rest position of FIG. 1. This results in a clockwise pivotal movement of the leg activating lever 56 (FIGS. 3 and 4) and a counterclockwise movement of the upper lever 34 as the expansible bellows 30 contacts while the compressed air begins to pass out through the tube 28 and mouth 24.

From the foregoing it will be seen that the novel nursing doll 10 and nursing bottle 12 constructed in accordance with the features of the present invention provide a highly realistic animated doll which is suitable for entertaining young children and the like for long hours of pleasure.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated doll which realistically simulates the movement of a baby, when given a bottle, to grasp the bottle comprising:

a hollow body with a head with a mouth opening and movable limbs in the shape of arms and legs attached to the body said limbs in the shape of legs having ends in the shape of feet;

pneumatic motor means for moving said limbs between a first position spaced away from said fluid pump when in said feeding position and a second position wherein the outer end of each of said limbs is adjacent said pump appearing to hold said pump, each of said limbs extending outwardly of said body in said first position and being pivotal toward said second position, said motor means in said body in fluid communication with said mouth opening and drivingly connected to move said limbs;

a fluid pump generally in the shape of a baby's bottle having an outlet insertable into said mouth opening, said pump in a feeding position centered over said body near said mouth opening for operating said pneumatic motor means to move said limbs; and means for rotating at least one of said limbs in the shape of legs around an axis extending along the length of said limb as said limb is moved by said motor means from said first to said second position.

* * * * *